US011257449B2

(12) United States Patent
He

(10) Patent No.: US 11,257,449 B2
(45) Date of Patent: Feb. 22, 2022

(54) DISPLAY DEVICE DRIVING METHOD, DISPLAY DEVICE

(71) Applicant: TCL CHINA STAR OPTOELECTRONICS TECHNOLOGY CO., LTD., Guangdong (CN)

(72) Inventor: Guanxian He, Shenzhen (CN)

(73) Assignee: TCL CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 15/733,064

(22) PCT Filed: Apr. 15, 2020

(86) PCT No.: PCT/CN2020/084838
§ 371 (c)(1),
(2) Date: May 6, 2020

(87) PCT Pub. No.: WO2021/196287
PCT Pub. Date: Oct. 7, 2021

(65) Prior Publication Data

US 2021/0312877 A1 Oct. 7, 2021

(30) Foreign Application Priority Data

Apr. 3, 2020 (CN) ..... 202010258609.4

(51) Int. Cl.
*G09G 5/10* (2006.01)
*G09G 3/36* (2006.01)
*G09G 3/3208* (2016.01)

(52) U.S. Cl.
CPC ..... *G09G 3/3611* (2013.01); *G09G 3/3208* (2013.01); *G09G 2320/0233* (2013.01); *G09G 2320/0252* (2013.01)

(58) Field of Classification Search
CPC ..... G09G 3/3611; G09G 3/3208; G09G 2320/0233; G09G 2320/0252
(Continued)

(56) References Cited

U.S. PATENT DOCUMENTS 10,733,958 B1 * 8/2020 Kuo ..... G09G 5/006
2003/0076288 A1 4/2003 Fish
(Continued)

FOREIGN PATENT DOCUMENTS

CN 1571986 A 1/2005
CN 103761933 A 4/2014
(Continued)

*Primary Examiner* — Jennifer T Nguyen
(74) *Attorney, Agent, or Firm* — The Roy Gross Law Firm, LLC; Roy Gross

(57) ABSTRACT

The present invention provides a display device driving method and a display device. The method directly loads compression de-mura data in a compressed state into a memory during booting, which enhances a booting speed. Decoding only performed for current display position when images are displayed, which lowers occupation of the memory. Furthermore, multi-thread parallel decoding of the de-mura data is achieved by identifiers and decoding modules, which drastically increases a decoding speed.

18 Claims, 9 Drawing Sheets

(58) Field of Classification Search
USPC ..... 345/204, 690
See application file for complete search history.

(56) References Cited

U.S. PATENT DOCUMENTS

| | | | | |
|---|---|---|---|---|
| 2014/0055849 | A1* | 2/2014 | Son | G02B 5/0268 359/361 |
| 2015/0187306 | A1 | 7/2015 | Syu et al. | |
| 2017/0139279 | A1* | 5/2017 | Suwa | G02F 1/134309 |
| 2018/0137812 | A1 | 5/2018 | Yan et al. | |
| 2018/0191371 | A1 | 7/2018 | Tao et al. | |
| 2018/0240440 | A1* | 8/2018 | Furihata | G09G 3/3275 |
| 2018/0357945 | A1 | 12/2018 | Tang et al. | |
| 2020/0005693 | A1* | 1/2020 | Furihata | G09G 3/006 |
| 2021/0065641 | A1* | 3/2021 | He | G09G 3/3655 |
| 2021/0210007 | A1* | 7/2021 | Stan | G09G 3/20 |

FOREIGN PATENT DOCUMENTS

| | | | |
|---|---|---|---|
| CN | 106339196 | A | 1/2017 |
| CN | 106531045 | A | 3/2017 |
| CN | 106782264 | A | 5/2017 |
| CN | 107977182 | A | 5/2018 |
| CN | 109889846 | A | 6/2019 |
| CN | 110246469 | A | 9/2019 |

* cited by examiner

| | | | | | | | | | |
|---|---|---|---|---|---|---|---|---|---|
| R-1-i-Z | R-1-i-Y | R-2-i-Z | R-2-i-Y | R-3-i-Z | R-3-i-Y | …… | …… | B-5-i-Z | B-5-i-Y |

FIG. 4c

DISPLAY DEVICE DRIVING METHOD, DISPLAY DEVICE

FIELD OF INVENTION

The present invention relates to a field of display technologies, especially relates to a display device driving method, display device.

BACKGROUND OF INVENTION

When a display device is used, an evenness of brightness is one of important indicators of estimating display performance of the display device. The display device, when operating, has various contaminated mura blocks due to unevenness of brightness, which results in lowered comfortability for a user. Such phenomenon of the operating display device with uneven brightness to affect image quality and effect is called mura. Mura refers to visible imperfection on a surface of a pixel array when a display operates. A mura defect is usually greater than one pixel unit, has an unfixed shape, a blur edge, and a low contrast.

A cause of the mura defects is defects of the circuit or structure of the display device or unevenness characteristics of material, and variation of processing conditions. Because a manufacturing process of the display device is complicated and has hundreds of steps, mura defects are likely generated when each of the steps has not be implemented well. Therefore, to eliminate influence of the mura to the display device, usually the display device with mura is modified to for de-mura processing, for example, mura information of the display device is analyzed to acquire a position of a mura region and a de-mura compensation value including the mura information of the region, and then the position and the value are compressed and stored in a storage device of the display device. After booting, a decoding module is used to serial-decode the compressed data and load the decoded data in to a memory (DDR memory), and then displayed contents of a corresponding region of the display device are modulated correspondingly according to the decoded de-mura compensation value in the memory to suppress and mitigate mura information included to enhance the evenness of the displayed contents such that the display effect of the display contents is improved.

However, with the enhancement of a resolution of the display device, for example, appearance of 8K products, de-mura data required by the display device becomes greater, a time needed for a conventional serial-decoding process increases, and a memory space occupied by the decoded data stored in the memory becomes greater.

SUMMARY OF INVENTION

Technical Issue

The present invention provides a display device driving method and a display device to solve a technical issue that de-mura data required by a conventional high resolution display device and results in a longer decoding time.

Technical Solution

To solve the above issue, the present invention provides technical solutions as follows.

An embodiment of the present invention provides a display device driving method, configured to drive a display panel to operate, the display panel comprising display units arranged in an array, each of the display units comprising at least one pixel unit, and the display device driving method comprising:

reading compression de-mura data stored in a compressed state in a storage device, loading the compression de-mura data into a memory, wherein the compression de-mura data comprise a compressed de-mura datum for each of the display units and an identifier configured to identify a position of each of the compressed de-mura data;

calling at least two decoding modules;

parallel decoding the compression de-mura data corresponding to a current display position in the memory by the at least two decoding modules based on the identifiers, and acquiring an actual de-mura datum of each of the display units after decoding in the current display position; and utilizing the actual de-mura datum of the each of the display units to drive the display panel to operate.

In the display device driving method provided by the embodiment of the present invention, the based on the identifiers, the step of parallel decoding the compression de-mura data corresponding to a current display position in the memory by the at least two decoding modules based on the identifiers, and acquiring an actual de-mura datum of each of the display units after decoding in the current display position, comprises:

establishing a mapping relation between the decoding modules and the de-mura data;

reading the compression de-mura data corresponding to the current display position in the memory; and parallel decoding the compressed de-mura data of each of the decoding modules corresponding to a de-mura data type in the memory by the decoding modules based on the identifiers and the mapping relation.

In the display device driving method provided by the embodiment of the present invention, the based on the identifiers and the mapping relation, the step of parallel decoding the compressed de-mura data of each of the decoding modules corresponding to a de-mura data type in the memory by the decoding modules based on the identifiers and the mapping relation, comprises:

determining a position and a type of the compressed de-mura datum of each of the display units in the compression de-mura data based on the identifiers; and utilizing the decoding modules to parallel decode the compressed de-mura data of a corresponding type according to the position and the type of the compressed de-mura datum of each of the display units in the compression de-mura data.

In the display device driving method provided by the embodiment of the present invention, the step of utilizing the decoding modules to parallel decode the compressed de-mura data of a corresponding type according to the position and the type of the compressed de-mura datum of each of the display units in the compression de-mura data, comprises:

data-extracting of the compression de-mura data and acquiring the compressed de-mura data according to the positions of the compressed de-mura datum of each of the display units in the compression de-mura data;

dispensing the compressed de-mura data to corresponding ones of the decoding modules according to the types of the compressed de-mura datum of each of the display units of the compression de-mura data; and utilizing the decoding modules to decode the dispensed compressed de-mura data.

In the display device driving method provided by the embodiment of the present invention, the step of utilizing the decoding modules to parallel decode the compressed de-mura data of a corresponding type according to the position and the type of the compressed de-mura datum of each of the display units in the compression de-mura data, comprises:

dispensing the positions of the compressed de-mura datum of each of the display units in the compression de-mura data to corresponding ones of the decoding modules; and utilizing the decoding modules to data-extract the compression de-mura data according to the position of the compressed de-mura datum of each of the display units in the compression de-mura data to acquire and decode the compressed de-mura data.

In the display device driving method provided by the embodiment of the present invention, the step of determining a position and a type of the compressed de-mura datum of each of the display units in the compression de-mura data based on the identifiers, comprises:

parsing storage fields of the identifiers of the compression de-mura data to acquire one of the identifiers corresponding to each of the compressed de-mura data; and determining the position and the type of the compressed de-mura datum of each of the display units in the compression de-mura data according to contents of the identifier that is uncompressed.

In the display device driving method provided by the embodiment of the present invention, the step of determining a position and a type of the compressed de-mura datum of each of the display units in the compression de-mura data based on the identifiers, comprises:

parsing a current one of the identifiers to acquire contents of the current one of the identifiers;

determining a position of a next one of the identifiers and a type of the compressed de-mura data corresponding to the next one of the identifiers according to the contents of the current one of the identifiers; and determining a position of the compressed de-mura data corresponding to the next one of the identifiers according to the position of the next one of the identifiers and a content length of the next one of the identifiers.

In the display device driving method provided by the embodiment of the present invention, the step of determining a position and a type of the compressed de-mura datum of each of the display units in the compression de-mura data based on the identifiers, comprises:

parsing a current one of the identifiers to acquire contents of the current one of the identifiers;

determining a position of a next one of the identifiers according to the contents of the current one of the identifiers;

determining a position of the compressed de-mura data corresponding to the next one of the identifiers according to the position of the next one of the identifiers and a content length of the next one of the identifiers; and determining a type of the compressed de-mura datum of the corresponding to the next one of the identifiers according to contents of the next one of the identifiers and a storage sequence of the compressed de-mura data of different types of the display units in the compression de-mura data.

The embodiment of the present invention also provides a display device, comprising:

a display panel comprising display units arranged in an array, the display units comprising at least one pixel unit;

a storage device configured to store compression de-mura data in a compressed state, wherein the compression de-mura data comprises a compressed de-mura datum of each of the display units and an identifier configured to identify a position of each of the compressed de-mura data;

a memory comprising a plurality of decoding modules configured to read the compression de-mura data stored in the compressed state in the storage device and load the compression de-mura data into a memory, and configured to call at least two of the decoding modules, based on the identifiers, and configured to parallel decode the compression de-mura data corresponding to a current display position in the memory by the at least two decoding modules based on the identifiers, and acquiring an actual de-mura datum of each of the display units after decoding in the current display position; and a driver chip configured to utilize the actual de-mura datum of the each of the display units to drive the display panel to operate.

In the display device provided by the embodiment of the present invention, the display panel comprises at least one of a liquid crystal display panel and an organic light emitting diode (OLED) display panel.

In the display device provided by the embodiment of the present invention, the memory is further configured to: establish a mapping relation between the decoding modules and the de-mura data; read the compression de-mura data corresponding to the current display position in the memory; and parallel decode the compressed de-mura data of each of the decoding modules corresponding to a de-mura data type in the memory by the decoding modules based on the identifiers and the mapping relation.

In the display device provided by the embodiment of the present invention, the memory is further configured to: determine a position and a type of the compressed de-mura datum of each of the display units in the compression de-mura data based on the identifiers; and utilize the decoding modules to parallel decode the compressed de-mura data of a corresponding type according to the position and the type of the compressed de-mura datum of each of the display units in the compression de-mura data.

In the display device provided by the embodiment of the present invention, the memory is further configured to: data-extract of the compression de-mura data and acquire the compressed de-mura data according to the positions of the compressed de-mura datum of each of the display units in the compression de-mura data; dispense the compressed de-mura data to corresponding ones of the decoding modules according to the types of the compressed de-mura datum of each of the display units of the compression de-mura data; and utilize the decoding modules to decode the dispensed compressed de-mura data.

In the display device provided by the embodiment of the present invention, the memory is further configured to: dispense the positions of the compressed de-mura datum of each of the display units in the compression de-mura data to corresponding ones of the decoding modules; and utilize the decoding modules to data-extract the compression de-mura data according to the position of the compressed de-mura datum of each of the display units in the compression de-mura data to acquire and decode the compressed de-mura data.

In the display device provided by the embodiment of the present invention, the memory is further configured to: parse storage fields of the identifiers of the compression de-mura data to acquire one of the identifiers corresponding to each of the compressed de-mura data; and determine the position and the type of the compressed de-mura datum of each of the display units in the compression de-mura data according to contents of the identifiers that are decoded.

In the display device provided by the embodiment of the present invention, the memory is further configured to: parse a current one of the identifiers to acquire contents of the current one of the identifiers; determine a position of a next one of the identifiers according to the contents of the current one of the identifiers; and determine a position of the compressed de-mura data corresponding to the next one of the identifiers according to the position of the next one of the identifiers and a content length of the next one of the identifiers.

In the display device provided by the embodiment of the present invention, the memory is further configured to: parse a current one of the identifiers to acquire contents of the current one of the identifiers; determine a position of a next one of the identifiers according to the contents of the current one of the identifiers; determine a position of the compressed de-mura data corresponding to the next one of the identifiers according to the position of the next one of the identifiers and a content length of the next one of the identifiers; and determine a type of the compressed de-mura datum of the corresponding to the next one of the identifiers according to contents of the next one of the identifiers and a storage sequence of the compressed de-mura data of different types of the display units in the compression de-mura data.

In the display device provided by the embodiment of the present invention, the display panel comprises a first substrate and a second substrate that are disposed opposite to each other in a cell, and a liquid crystal layer filled between the first substrate and the second substrate, the first substrate comprises an underlay, a driver circuit layer, a pixel electrode layer and a diffusing layer, the driver circuit layer is formed on a side of the underlay; the pixel electrode layer is formed on a side of the driver circuit layer away from the underlay and comprises a plurality of pixel electrodes arranged in an array and independent from one another, each of the pixel electrodes comprise an electrode surface located away from the underlay; the diffusing layer is formed on a side of the pixel electrode layer away from the driver circuit layer and comprises a plurality of diffusing members arranged in an array and connected to one another, the diffusing members correspond to the pixel electrodes, each of the diffusing members comprises a light emitting surface away from the pixel electrodes, and an area of the light emitting surface is greater than an area of the electrode surface.

In the display device provided by the embodiment of the present invention, the light emitting surface is a convex surface.

In the display device provided by the embodiment of the present invention, the light emitting surface is a concave surface.

Advantages

Advantages of the present invention are as follows. The present invention provides a display device driving method and a display device. The method comprises: reading compression de-mura data stored in a compressed state in a storage device, loading the compression de-mura data into a memory, wherein the compression de-mura data comprise a compressed de-mura datum for each of the display units and an identifier configured to identify a position of each of the compressed de-mura data; calling at least two decoding modules; parallel decoding the compression de-mura data corresponding to a current display position in the memory by the at least two decoding modules based on the identifiers, and acquiring an actual de-mura datum of each of the display units after decoding in the current display position; and utilizing the actual de-mura datum of the each of the display units to drive the display panel to operate. The method directly loads the compression de-mura data of the compressed state into the memory without decoding when the display device is booting, which increases booting speed. The method only decodes a current display position when images are displayed such that in the memory only the de-mura data of the current display position is in a decoding status, and other positions are still in a compressed state, which drastically reduces occupation to the memory. Also, multi-thread parallel decoding of the de-mura data has been achieved based on the identifiers and the multiple decoding modules, which greatly increases decoding speed such that a later electrifying time is increased to stabilize display effect.

DESCRIPTION OF DRAWINGS

To more clearly elaborate on the technical solutions of embodiments of the present invention or prior art, appended figures necessary for describing the embodiments of the present invention or prior art will be briefly introduced as follows. Apparently, the following appended figures are merely some embodiments of the present invention. A person of ordinary skill in the art may acquire other figures according to the appended figures without any creative effort.

FIGS. 4*a* to 4*d* are schematic views of arrangement provided by the embodiment of the present invention.

DETAILED DESCRIPTION OF PREFERRED EMBODIMENTS

Figure 1:
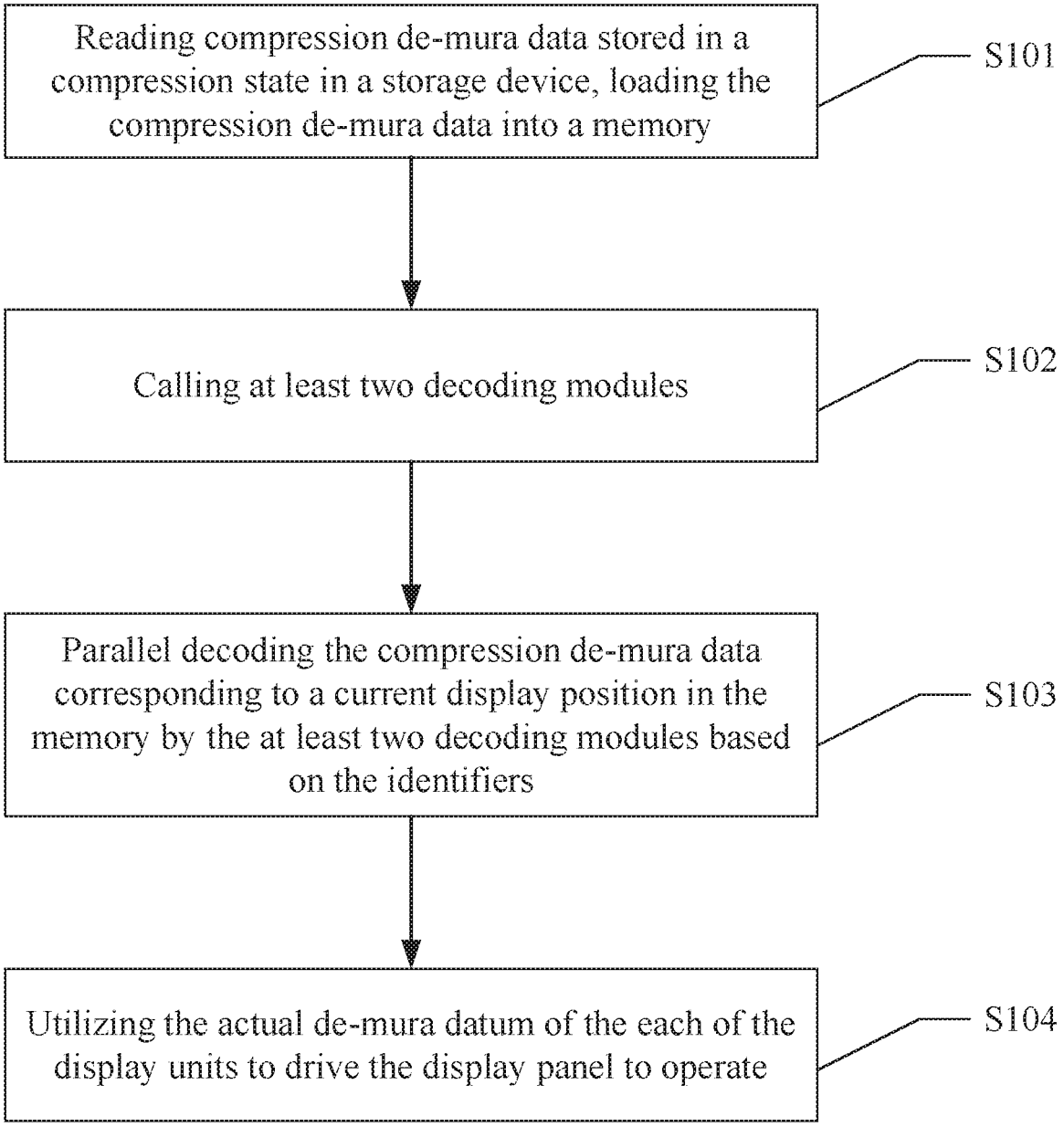
FIG. 1 is a flowchart of a display device driving method provided by the embodiment of the present invention.

Each of the following embodiments is described with appending figures to illustrate specific embodiments of the present invention that are applicable. The terminologies of direction mentioned in the present invention, such as "upper", "lower", "front", "rear", "left", "right", "inner", "outer", "side surface", etc., only refer to the directions of the appended figures. Therefore, the terminologies of direction are used for explanation and comprehension of the present invention, instead of limiting the present invention. In the figures, units with similar structures are marked with the same reference characters.

With regard to the technical issue that de-mura data required by the conventional high resolution display device becomes greater and results in a longer time needed for decoding, the embodiment of the present invention can mitigate the issue.

With reference to FIG. 1, the display device driving method provided by the embodiment of the present invention comprises steps S101 to S104:

The step S101 comprises reading compression de-mura data stored in a compressed state in a storage device and loading the compression de-mura data into a memory.

Figure 3:
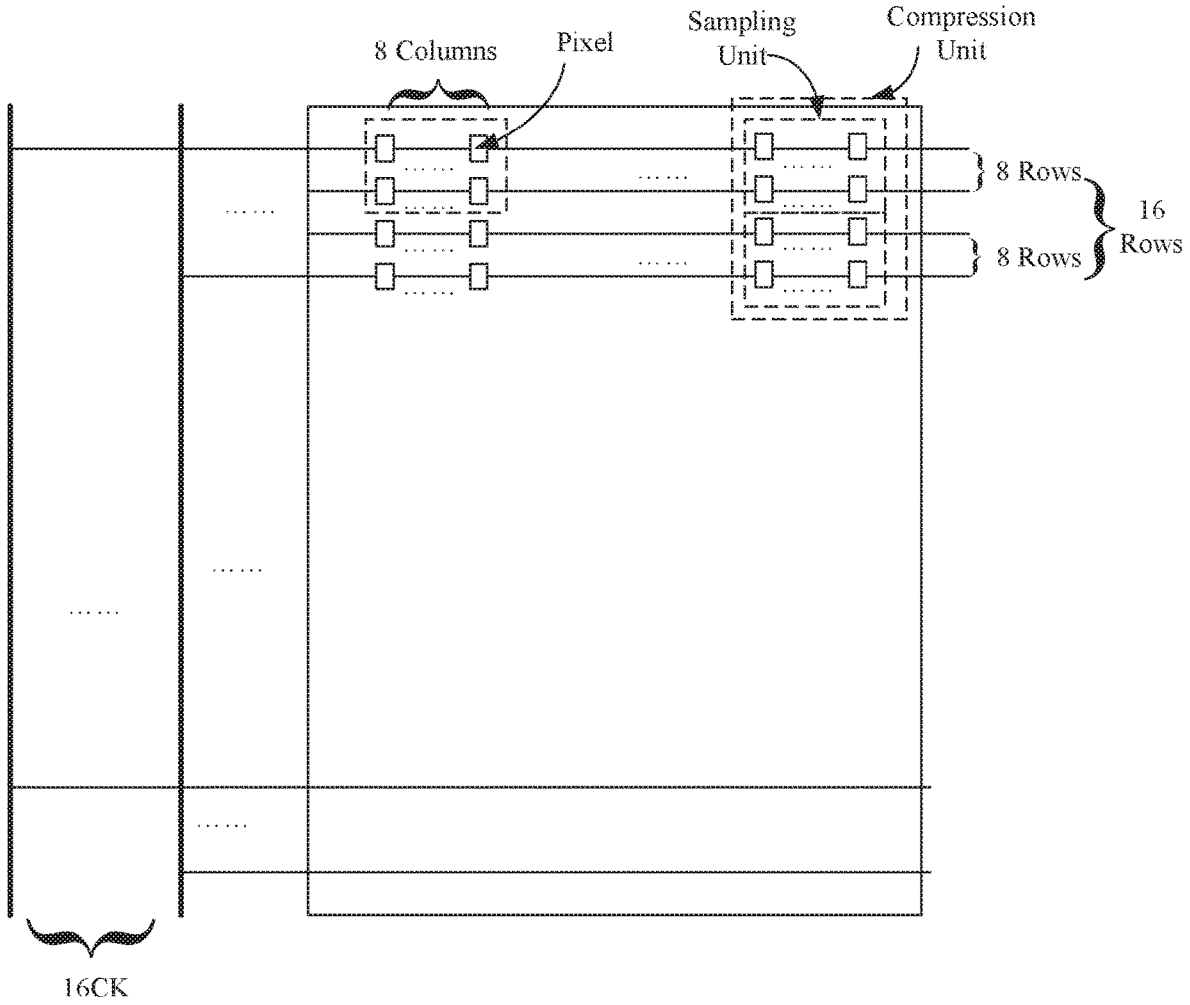
FIG. 3 is a schematic view of connection of the display panel provided by the embodiment of the present invention.

In an embodiment, the display panel comprises display units arranged in an array, the display units comprises at least one pixel unit. In a conventional de-mura technology, each of the pixels of the display panel is processed, in other words, each pixel corresponds to a de-mura value. With increase of the resolution of the display panel, such method results in greater occupation of the storage space. As such, with reference to FIG. 3, the present invention employs a downsampling technology, sets two concepts of sampling units and compression units. A size of the sampling unit (a number of the pixels included) can be set as required. The present invention aims at a 8K (a resolution thereof is 7680*4320) high definition display panel, sets the size of the sampling unit as 8*8 (8 columns*8 rows), each sampling unit comprises 64 pixels, and such 64 pixels use the same de-mura value. As such, the quantity of the de-mura data corresponding to the display panel can be scaled down to 1/64. In the pixel driving direction and driving sequence, each of the compression units comprises a plurality of sampling units. With reference to FIG. 3, the 8K display panel provided by the embodiment of the present invention employs a gate driver on array (GOA) driver circuit of 16CK (clock signal line). When images are displayed, in each display frame, according to a sequence from top to bottom, the pixels of 16 rows are scanned and driven, each of the compression units has 64 sampling units, i.e., 32*2 (32 columns*2 rows) sampling units. Each display position (i.e., the pixels of 16 rows) comprises 30 (i.e., 7680÷32÷8) compression units, and the compression de-mura data corresponding to each display position comprises compression de-mura data corresponding to the 30 compression units. The compression de-mura data corresponding to each of the compression units comprises the compression de-mura data corresponding to 64 sampling units. For convenience of understanding, the present invention makes the display units equal to the compression units, in other words, each of the display units corresponds to each of the compression units.

In an embodiment, the present invention The pixels refers to pixels employing a true RGB structure, in other words, in the pixels of the same row of, red sub-pixels, green sub-pixels, and blue sub-pixels are arranged cyclically. With regard to the sampling units, providing such sub-pixels of three colors with corresponding de-mura values is required. Of course, based on other predictable embodiment of the present invention, the pixel can employ an arrangement of RGBW sub-pixels (a red sub-pixel, a green sub-pixel, a blue sub-pixel, and a white sub-pixel), and can employ a sub-pixel multiplexing configuration. In some predictable embodiments, sub-pixels of three different colors can be disposed with the same de-mura value, or sub-pixels of two different colors can be disposed with the same de-mura value.

Figure 4A:
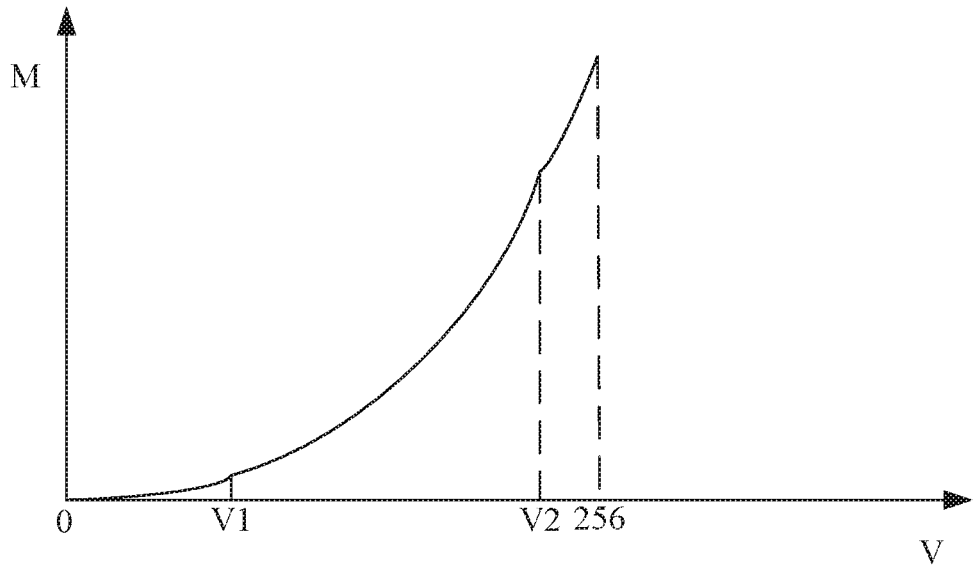

In an embodiment, with reference to FIG. 4*a*, a relationship between a driving voltage V (i.e., a grayscale voltage) and a light-emitting brightness M of a pixel is similar to an exponential function, and is called as a gamma curve. Even the process has deviation, a relationship between the driving voltage V (grayscale voltage) of each sub-pixel and the light-emitting brightness M is also similar to exponential function, and the difference is only the value of the exponential. When the de-mura values corresponding to different driving voltages are calculate by the exponential function, data become more complicated. Therefore, the present invention creatively employs function conversion, converts the exponential function into a similar combination of a primary function and a second function for calculate the de-mura values corresponding to the driving voltages V.

Figure 4B:
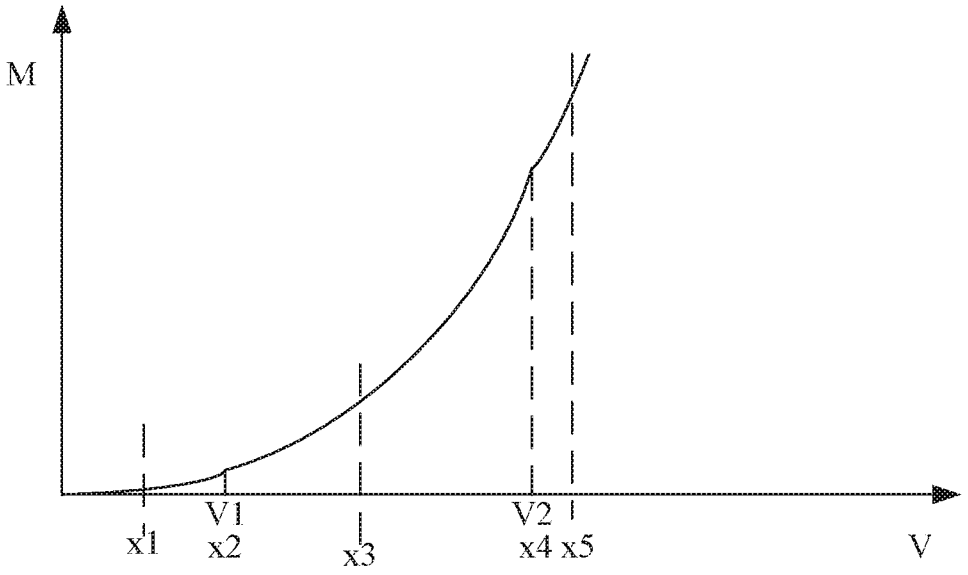

Taking a 8K display panel as an example, a driving voltage of the display panel is total 1024 grayscale levels of 0-1023. In a low grayscale region (0-V1) and a high grayscale region (V2-1023), a gamma curve is substantially a straight line. In a grayscale region (V1-V2), the gamma curve is similar to a parabola, the grayscale voltages V1 and V2 an be determined as an actual circumstance of each of the pixels in each of the sampling units. Accordingly, the present invention can sample de-mura values corresponding to 5 driving voltages with regard to each light-emitting color of each of the sampling units. Taking the red sub-pixel as an example, with reference to FIG. 4*b*, 5 theoretical driving voltages x1, x2, x3, x4, x5 are determined, wherein x2=V1, x4=V2, x1<x2<x3<x4<x5. brightness L1 corresponding to a theoretical driving voltage x1 is determined according to the gamma curve to drive the display panel to emit light. An actual driving voltage T1 corresponding to the sub-pixel is recorded while light-emitting brightness of the sub-pixel reaches L1 (average brightness of the sampling units) to acquire a relationship between a theoretical driving voltage x1 and an actual driving voltage T1 of the red sub-pixel an to sequentially acquire relationships among theoretical driving voltages x2, x3, x4, x5 and actual driving voltages T2, T3, T4, T5 of the red sub-pixel, relationships among theoretical driving voltages x1, x2, x3, x4, x5 and actual driving voltages T6, T7, T8, T9, T10 of the green sub-pixel, and relationships among the theoretical driving voltages x1, x2, x3, x4, x5 and actual driving voltages T11, T12, T13, T14, T15 of the blue sub-pixel. Each of the sampling units corresponds to 15 de-mura data. Because each of the compression units include 64 sampling units, a number of de-mura data blocks of each of the compression units is 15. Each de-mura data block includes de-mura data corresponding to the 64 sampling units. For example, marks of the 15 de-mura data blocks of the compression units i (i refers to a mark of the compression units, and the mark corresponds to an only one compression unit in the display panel) are R-1–i, R-2–i, R-3–i, R-4–i, R-5–i, G-1–i, G-2–i, G-3–i, G-4–i, G-5–i, B-1–i, B-2–i, B-3–i, B-4–i, B-5–i. The de-mura data block R-1–I comprises the relationships among the theoretical driving voltages x1 (minimum brightness) and the actual driving voltages T1 of the red sub-pixels of the 64 sampling units of the compression units i. The de-mura data block R-2-I comprises the relationships among the theoretical driving voltages x2 (greater brightness) and the actual driving voltages T2 of the red sub-pixels of the 64 sampling units of the compression units i.

To reduce the data, the 15 de-mura data blocks R-1–i, R-2–i, R-3–i, R-4–i, R-5–i, G-1–i, G-2–i, G-3–i, G-4–i, G-5–i, B-1–i, B-2–i, B-3–i, B-4–i, B-5–I of the compression units i are compressed sequentially. Because an actual data of each de-mura data block R (G/B)–1 (2/3/4/5)–i is different in value and varies, after corresponding compression, a compression data of each de-mura data block is also different in value. Theoretically, only after a current de-mura data block compression data is decoded completely can a start position of a next de-mura data block compression data be acquired. In other words, the de-mura data block compression data can only be serial-decoded, the manner needs a longer decoding time. With regard to such issue, the embodiment of the present invention providing a solution for parallel decoding the de-mura data block compression data. Accordingly, the present invention improves the compression de-mura data storage method, the compression de-mura data comprise a compressed de-mura datum of each of the display units, and identifiers are configured to identify positions of the compressed de-mura data. With reference to FIG. 4*c*, for convenience of identification, a compression datum acquired by compressing the de-mura data block R (G/B)−1 (2/3/4/5)−I is indicated as R (G/B)−1 (2/3/4/5)−i−Y, an identifier for identifying a position of the de-mura data block R (G/B)−1 (2/3/4/5)−i−Y is indicated as R (G/B)−1 (2/3/4/5)−i−Z, wherein R can be replaced with G or B, and 1 can be replaced as one of 2 to 5. In FIG. 4*c*, the compressed de-mura data and the identifiers appear alternately. In other embodiment of the present invention, each of the compression de-mura data comprises a head file, the head file comprises identifiers R (G/B)−1 (2/3/4/5)−i−Z configured to identify positions of the compression data R (G/B)−1 (2/3/4/5)−i−Y of the compression units i of the display panel. In other words, all of the identifiers are stored in advance, and then the compression data are stored, etc.

In an embodiment, types of the compressed de-mura data comprise a light-emitting color (one of R, G, B) and a light-emitting intensity (one of 1 to 5). Lengths of the identifiers can be the same for example 20 bytes, former 16 bytes are configured for recording a position, and later 4 bytes are configured for recording a type.

The step S102 comprises calling at least two decoding modules.

In an embodiment, the step can call decoding modules of a corresponding number based on a total number of the type of the de-mura data. Under such circumstance, each of the decoding modules is configure to decode de-mura data of one type. Alternatively, the step can call decoding modules of a corresponding number based on a total number of the compression units of each display position. Under such circumstance, each of the decoding modules is configured to decode the de-mura data of one compression unit. Decoding modules of a corresponding number called based on the type of the de-mura data are described as follows, and other solutions and types will not be described repeatedly.

In an embodiment, with regard to 8K products, 15 decoding modules are called to implement the present invention, for example, a decoding module 3-01 to a decoding module are called to implement the present invention, a decoding modules 3-*i* is achieved by hardware.

The step S103 comprises parallel decoding the compression de-mura data corresponding to a current display position in the memory by the at least two decoding modules based on the identifiers, and acquiring an actual de-mura datum of each of the display units after decoding in the current display position.

Figure 4D:
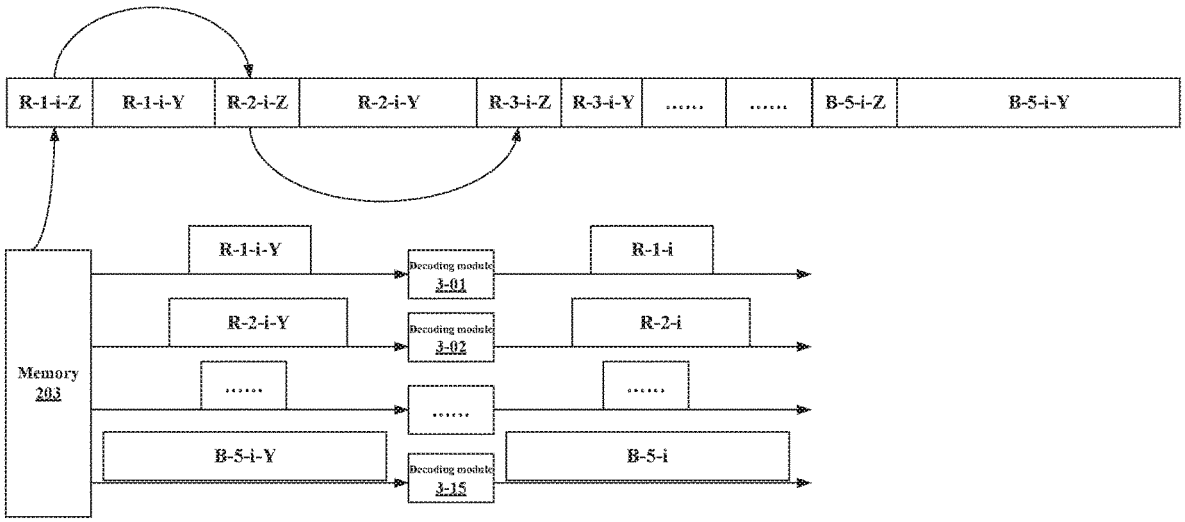

In an embodiment, the step comprises: establishing a mapping relation between the decoding modules and the de-mura data; reading the compression de-mura data corresponding to the current display position in the memory; and parallel decoding the compressed de-mura data of each of the decoding modules corresponding to a de-mura data type in the memory by the decoding modules based on the identifiers and the mapping relation. With reference to FIG. 4*d*, a de-mura data type corresponding to the decoding module 3-01 is R-1, and a de-mura data type corresponding to the decoding module 3-15 is B-5.

In an embodiment, the step of parallel decoding the compressed de-mura data of each of the decoding modules corresponding to a de-mura data type in the memory by the decoding modules based on the identifiers and the mapping relation, comprises: determining a position and a type of the compressed de-mura datum of each of the display units in the compression de-mura data based on the identifiers; and utilizing the decoding modules to parallel decode the compressed de-mura data of a corresponding type according to the position and the type of the compressed de-mura datum of each of the display units in the compression de-mura data. For example, 20 bytes of the identifier is parsed to acquire the positions and types of the compressed de-mura data and parsing is implemented based on the positions and types.

In an embodiment, the step of utilizing the decoding modules to parallel decode the compressed de-mura data of a corresponding type according to the position and the type of the compressed de-mura datum of each of the display units in the compression de-mura data, comprises: data-extracting of the compression de-mura data and acquiring the compressed de-mura data according to the positions of the compressed de-mura datum of each of the display units in the compression de-mura data; dispensing the compressed de-mura data to corresponding ones of the decoding modules according to the types of the compressed de-mura datum of each of the display units of the compression de-mura data; and utilizing the decoding modules to decode the dispensed compressed de-mura data. For example, the memory data-extracts of the compression de-mura data and acquiring the compressed de-mura data according to the positions of the compressed de-mura datum of each of the display units in the compression de-mura data, and then transmits the data to the decoding modules for decoding. In the present embodiment, data-extraction is implemented by the memory.

In an embodiment, the step of utilizing the decoding modules to parallel decode the compressed de-mura data of a corresponding type according to the position and the type of the compressed de-mura datum of each of the display units in the compression de-mura data, comprises: dispensing the positions of the compressed de-mura datum of each of the display units in the compression de-mura data to corresponding ones of the decoding modules; and utilizing the decoding modules to data-extract the compression de-mura data according to the position of the compressed de-mura datum of each of the display units in the compression de-mura data to acquire and decode the compressed de-mura data. For example, the memory dispenses the positions of the compressed de-mura datum of each of the display units in the compression de-mura data to corresponding ones of the decoding modules, and utilizes the decoding modules to data-extract the compression de-mura data according to the position of the compressed de-mura datum of each of the display units in the compression de-mura data to acquire and decode the compressed de-mura data. In the present embodiment, data-extraction is implemented by the decoding modules.

In an embodiment, the step of determining a position and a type of the compressed de-mura datum of each of the display units in the compression de-mura data based on the identifiers, comprises: parsing storage fields of the identifiers of the compression de-mura data to acquire one of the identifiers corresponding to each of the compressed de-mura data; and determining the position and the type of the compressed de-mura datum of each of the display units in the compression de-mura data according to contents of the identifier that is uncompressed. For example, a header field is disposed in the compression de-mura data as storage fields of the identifiers, all identifiers are acquired after the header field is uncompressed. Positions and types of all compressed de-mura data can be identified according to contents of each of the identifiers.

In an embodiment, the step of determining a position and a type of the compressed de-mura datum of each of the display units in the compression de-mura data based on the identifiers, comprises: parsing a current one of the identifiers to acquire contents of the current one of the identifiers;

determining a position of a next one of the identifiers and a type of the compressed de-mura data corresponding to the next one of the identifiers according to the contents of the current one of the identifiers; and determining a position of the compressed de-mura data corresponding to the next one of the identifiers according to the position of the next one of the identifiers and a content length of the next one of the identifiers. For example, a length of each of the identifiers is 20 bytes, and increasing a position of a next one of the identifiers for 20 bytes would acquire a position of the compressed de-mura datum corresponding to the next one of the identifiers.

In an embodiment, the step of determining a position and a type of the compressed de-mura datum of each of the display units in the compression de-mura data based on the identifiers, comprises: parsing a current one of the identifiers to acquire contents of the current one of the identifiers; determining a position of a next one of the identifiers according to the contents of the current one of the identifiers; determining a position of the compressed de-mura data corresponding to the next one of the identifiers according to the position of the next one of the identifiers and a content length of the next one of the identifiers; and determining a type of the compressed de-mura datum of the corresponding to the next one of the identifiers according to contents of the next one of the identifiers and a storage sequence of the compressed de-mura data of different types of the display units in the compression de-mura data. For example, a length of each of the identifiers is 20 bytes, and increasing a position of a next one of the identifiers for 20 bytes would acquire a position of the compressed de-mura datum corresponding to the next one of the identifiers. For example, contents of the next one of the identifiers include compression sequence numbers. A storage sequence of the de-mura data is R-1–i, R-2–i, R-3–i, R-4–i, R-5–i, G-1–i, G-2–i, G-3–i, G-4–i, G-5–i, B-1–i, B-2–i, B-3–i, B-4–i, B-5–i for sequential compression, and the type can be identified according to compression sequence numbers and the storage sequence.

In an embodiment, with reference to FIG. 4*d*, 15 decoding modules are called to decode data of 15 types simultaneously, however. Because variable length encoding, a length of each data block is uncertained, and an identifier is required to be added before each data block. When decoding is performed, identifier jump module reads positions from the identifier R-1–i–Z to the identifier R-2–i–Z. When the first decoding module 3-01 starts to decode R-1–i–Y, the memory can extract R-2–i–Y out from the identifier R-2–i–Z and give it to the second decoding module 3-02 while acquiring a position of the identifier R-3–i–Z, and so on. By jumping under indication of the 15 identifiers, the 15 decoding modules can workd simultaneously.

An analysis of advantages of the embodiment of the present invention is as follows. For a 8K display panel with a 60 Hz refresh rate, a clock frequency of 594 MHz is usually adopted in the industries, under a fatest situation, a displayed image thereof only has 30720 clock cycles per 16 rows. In other words, an average time available for uncompressing each data block R (G/B)–1 (2/3/4/5)–i–Y is 68 (30720÷30÷15) clock cycles. Because the compression employs variable length encoding, only a previous datum has been processed can a start position of the next datum be identified. Furthermore, each data block has most 64 data (data of each of the sampling units), in other words, under the worst situation, extracting data requires a time of 64 clock cycles. Under further consideration of conversion operation after data extraction, the total time inevitably exceeds the limitation of 68 clock cycles, which fails the function of real-time operation. The present invention jumps under indication of the 15 identifiers, and the 15 decoding modules can workd simultaneously. The limitation of the clock cycles corresponding to each data block increases from 68 to 1024 (30720÷30), such that the de-mura compression data of the 8K display panel can be uncompressed in real time to lower the hardware cost and production time.

The step S104 comprises utilizing the actual de-mura data of the each of the display units to drive the display panel to operate.

In an embodiment, after the actual de-mura data of each of the display units is acquired, for a certain light-emitting color of a certain one of the sampling units, an average driving voltage (theoretical value) xp of all sub-pixels of the light-emitting color of the sampling unit in a next display frame can be calculated out, then a grayscale region corresponding to the average driving voltage (theoretical value) xp is determined, an actual driving voltage Tx of the average driving voltage (theoretical value) xp can be calculated out by calling a corresponding relationship to further acquire the de-mura data (xp−Tx) corresponding to the sub-pixel of the light-emitting color in the sampling unit. On such basis, a sum of the theoretical driving voltage (theoretical value) x and the de-mura data (xp−Tx) of each sub-pixel can determine an actual driving voltage V (V=x+xp−Tx) of each sub-pixel to further complete the de-mura function.

Figure 2:
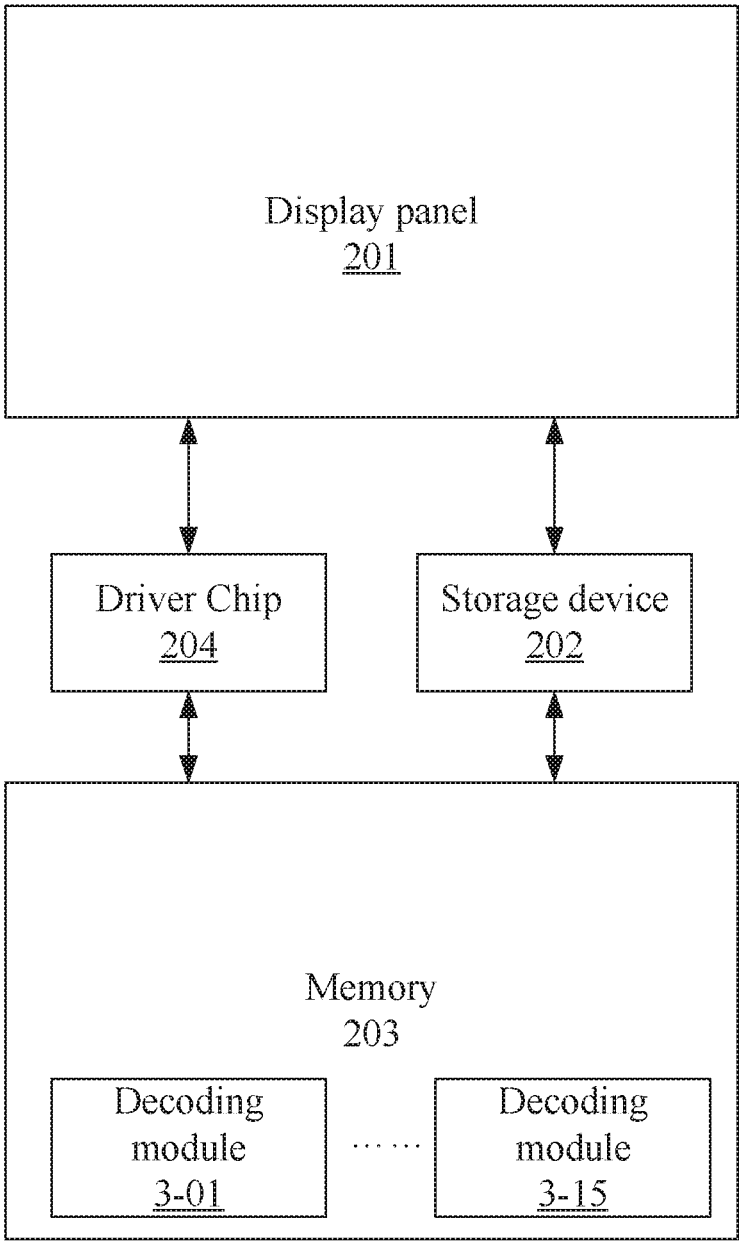
FIG. 2 is a schematic view of a module of the display device provided by the embodiment of the present invention.

In an embodiment, with reference to FIG. 2, the display device provided by the embodiment of the present invention comprises:

a display panel 201 comprising display units arranged in an array, and each of the display units comprising at least one pixel unit;

a storage device 202 configured to store compression de-mura data in a compressed state, wherein the compression de-mura data comprises a compressed de-mura datum of each of the display units and an identifier configured to identify a position of each of the compressed de-mura data;

a memory 203 comprising a plurality of decoding modules 3 configured to read the compression de-mura data stored in the compressed state in the storage device and load the compression de-mura data into a memory, and configured to call at least two of the decoding modules 3, based on the identifiers, and configured to parallel decode the compression de-mura data corresponding to a current display position in the memory by the at least two decoding modules 3 based on the identifiers, and acquiring an actual de-mura datum of each of the display units after decoding in the current display position; and a driver chip 204 configured to utilize the actual de-mura datum of the each of the display units to drive the display panel 201 to operate.

In an embodiment, the display panel 201 comprises at least one of a liquid crystal display panel and an organic light emitting diode (OLED) display panel.

In an embodiment, the memory is further configured to: establish a mapping relation between the decoding modules and the de-mura data; read the compression de-mura data corresponding to the current display position in the memory; and parallel decode the compressed de-mura data of each of the decoding modules corresponding to a de-mura data type in the memory by the decoding modules based on the identifiers and the mapping relation.

In an embodiment, the memory is further configured to: determine a position and a type of the compressed de-mura datum of each of the display units in the compression de-mura data based on the identifiers; and utilize the decoding modules to parallel decode the compressed de-mura data of a corresponding type according to the position and the type of the compressed de-mura datum of each of the display units in the compression de-mura data.

In an embodiment, the memory is further configured to: data-extract of the compression de-mura data and acquire the compressed de-mura data according to the positions of the compressed de-mura datum of each of the display units in the compression de-mura data; dispense the compressed de-mura data to corresponding ones of the decoding modules according to the types of the compressed de-mura datum of each of the display units of the compression de-mura data; and utilize the decoding modules to decode the dispensed compressed de-mura data.

In an embodiment, the memory is further configured to: dispense the positions of the compressed de-mura datum of each of the display units in the compression de-mura data to corresponding ones of the decoding modules; and utilize the decoding modules to data-extract the compression de-mura data according to the position of the compressed de-mura datum of each of the display units in the compression de-mura data to acquire and decode the compressed de-mura data.

In an embodiment, the memory is further configured to: parse storage fields of the identifiers of the compression de-mura data to acquire one of the identifiers corresponding to each of the compressed de-mura data; and determine the position and the type of the compressed de-mura datum of each of the display units in the compression de-mura data according to contents of the identifiers that are decoded.

In an embodiment, the memory is further configured to: parse a current one of the identifiers to acquire contents of the current one of the identifiers; determine a position of a next one of the identifiers according to the contents of the current one of the identifiers; and determine a position of the compressed de-mura data corresponding to the next one of the identifiers according to the position of the next one of the identifiers and a content length of the next one of the identifiers.

In an embodiment, the memory is further configured to: parse a current one of the identifiers to acquire contents of the current one of the identifiers; determine a position of a next one of the identifiers according to the contents of the current one of the identifiers; determine a position of the compressed de-mura data corresponding to the next one of the identifiers according to the position of the next one of the identifiers and a content length of the next one of the identifiers; and determine a type of the compressed de-mura datum of the corresponding to the next one of the identifiers according to contents of the next one of the identifiers and a storage sequence of the compressed de-mura data of different types of the display units in the compression de-mura data.

In an embodiment, with regard to the 8K liquid crystal display panel, the light emitting angle needs to be increased. Therefore, the present invention provides the following embodiment.

Figure 5A:
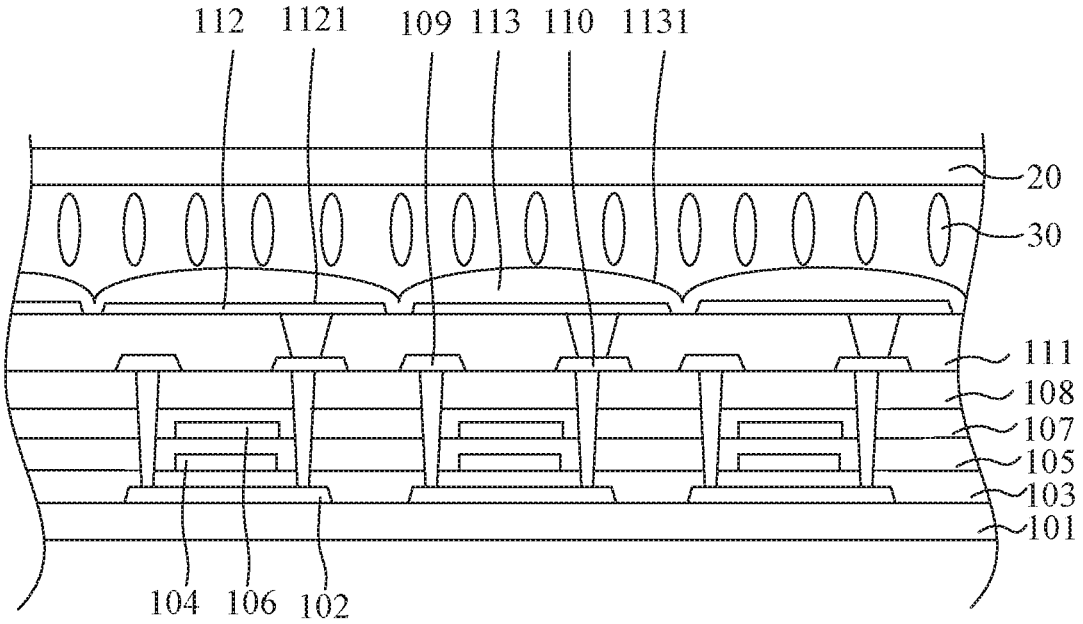
FIG. 5*a* is a first schematic structural view of the display panel provided by the embodiment of the present invention.
Figure 5B:
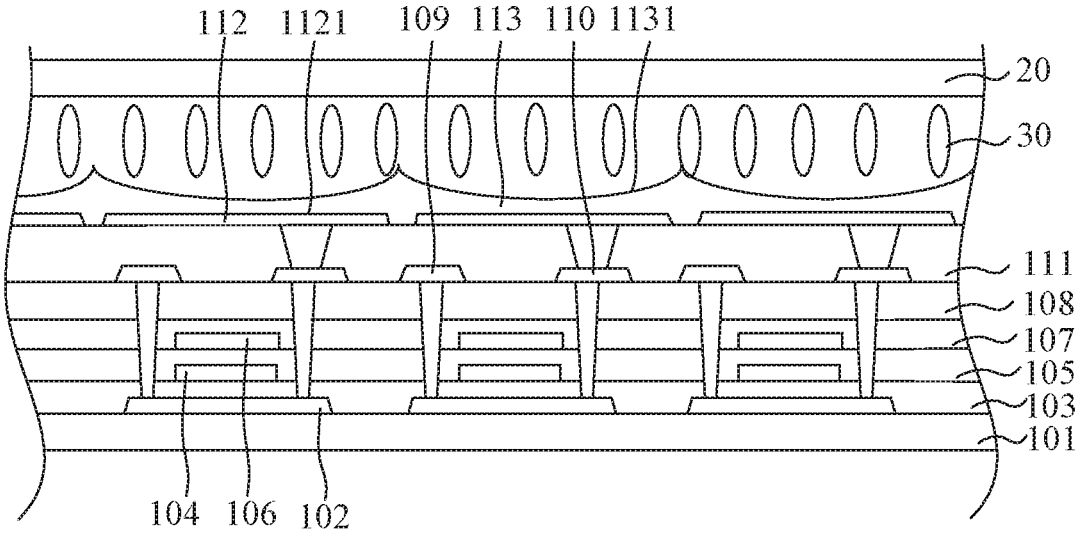
FIG. 5*b* is a second schematic structural view of the display panel provided by the embodiment of the present invention.

With reference to FIGS. 5*a* and 5*b*, the present invention also provides a liquid crystal display panel, comprising a first substrate and a second substrate 20 that are disposed opposite to each other in a cell, and a liquid crystal layer 30 filled between the first substrate and the second substrate 20. The first substrate comprises an underlay 101, a driver circuit layer, a pixel electrode layer, and a diffusing layer. The driver circuit layer is disposed on a side of the underlay 101. The pixel electrode layer is disposed on a side of the driver circuit layer away from the underlay 101 and comprises a plurality of pixel electrodes 112 arranged in an array and independent from one another. The pixel electrodes 112 comprises an electrode surface 1121 located away from the underlay 101. The diffusing layer is formed on a side of the pixel electrode layer away from the driver circuit layer and comprises a plurality of diffusing members 113 arranged in an array and connected to one another. The diffusing members 113 correspond to the pixel electrodes 112, and each of diffusing members 113 comprises a light emitting surface 1131 away from the pixel electrodes 112, and an area of the light emitting surface 1131 is greater than an area of the electrode surface 1121.

In the present embodiment, the liquid crystal display panel is a vertical alignment (VA) mode liquid crystal display panel, the first substrate is an array substrate, the second substrate is a color filter substrate. Therefore, it can also be applied to a COA type liquid crystal display panel.

The underlay 101 can be a flexible underlay or a rigid underlay, the driver circuit layer is formed on a side of the underlay 101 and comprises a plurality of thin film transistors, taking a bottom-gate type thin film transistor as an example, the thin film transistor comprises an active layer 102, a first gate electrode insulation layer 103, a first metal layer 104, a second gate electrode insulation layer 105, a second metal layer 106, an interlayer dielectric layer 107, a planarization layer 108, a source and drain electrode layer, and a passivation layer 111 that are stacked and disposed on the underlay 101.

The first metal layer 104 is patterned by an etching process to form a gate electrode and a first electrode plate of a storage capacitor of each of the thin film transistors. The second metal layer 106 is patterned to form a second electrode plate of the storage capacitor. The source and drain electrode layer to form a source electrode 109 and a drain electrode 110 of each of the thin film transistors by an etching process. The source electrodes 109 and the drain electrodes 110 are connected to the active layer 102 through first via holes.

The pixel electrode layer comprises a plurality of pixel electrodes 112 arranged in an array and independent from one another, the pixel electrodes 112 are connected to the drain electrodes 110 of the thin film transistors through second via holes. Each of the pixel electrodes 112 comprises an electrode surface 1121 located away from a side of the underlay 101, and the electrode surface 1121 is planar.

The diffusing layer is formed on the pixel electrode layer and comprises a plurality of diffusing members 113 arranged in an array and are connected to one another. The diffusing members 113 correspond to the pixel electrodes 112, and adjacent two of the diffusing members 113 are connected to each other, a region in which a connection portion thereof is located corresponds to a region between adjacent pixel electrodes 112. The diffusing members 113 comprises a side of the pixel electrodes 112 away from the light emitting surface 1131. After the liquid crystal display panel is bonded to the backlight module, incident light emitted from the backlight module extends through the pixel electrodes and the diffusing layer, and is emitted out from the light emitting surface 1131 of each of the diffusing members 113.

Incident light emitted by backlight module the is parallel light, the area of the light emitting surface 1131 of the diffusing members 113 is greater than the area of the electrode surface 1121 of the pixel electrodes 112, and is not planar, incident light has refraction around the light emitting surface 1131 and is refracted toward peripheries, which increases a light-emitting angle of the emitted light to effectively enhance the view angle of brightness and the view angle of chroma of the display panel.

In an embodiment, diffusing layer is a transparent material.

In an embodiment, transparent material is positive photoresist or negative photoresist.

In an embodiment, with reference to FIG. 5*a*, the light emitting surface 1131 is a convex surface.

In an embodiment, with reference to FIG. 5*b*, the light emitting surface 1131 is a concave surface.

In an embodiment, pixel electrodes 112 is a plane structure or a slit structure.

The present embodiment provides a liquid crystal display panel, by forming a diffusing layer on the pixel electrodes, and the area of the light emitting surface of the diffusing layer is greater than the area of the electrode surface of the of the pixel electrodes, after the liquid crystal display panel is made, light emitted from the backlight module enters the diffusing layer, and refraction occurs on the light emitting surface. Therefore, a light-emitting angle is increased and a view of angle is enhanced.

In the above-mentioned embodiments, the descriptions of the various embodiments are focused. For the details of the embodiments not described, reference may be made to the related descriptions of the other embodiments.

The display device driving method and the display device provided by the embodiment of the present invention are introduced in details as above. The principles and implementations of the present application are described in the following by using specific examples. The description of the above embodiments is only for assisting understanding of the technical solutions of the present application and the core ideas thereof. Those of ordinary skill in the art should understand that they can still modify the technical solutions described in the foregoing embodiments are or equivalently replace some of the technical features. These modifications or replacements do not depart from the essence of the technical solutions of the embodiments of the present application.

What is claimed is:

1. A display device driving method, configured to drive a display panel to operate, the display panel comprising display units arranged in an array, each of the display units comprising at least one pixel unit, and the display device driving method comprising:

reading compression de-mura data stored in a compressed state in a storage device, loading the compression de-mura data into a memory, wherein the compression de-mura data comprise a compressed de-mura datum for each of the display units and an identifier configured to identify a position of each of the compressed de-mura data;

calling at least two decoding modules;

parallel decoding the compression de-mura data corresponding to a current display position in the memory by the at least two decoding modules based on the identifiers, and acquiring an actual de-mura datum of each of the display units after decoding in the current display position; and utilizing the actual de-mura datum of the each of the display units to drive the display panel to operate;

wherein the step of parallel decoding the compression de-mura data corresponding to a current display position in the memory by the at least two decoding modules based on the identifiers, and acquiring an actual de-mura datum of each of the display units after decoding in the current display position, comprises:

establishing a mapping relation between the decoding modules and the de-mura data;

reading the compression de-mura data corresponding to the current display position in the memory; and parallel decoding the compressed de-mura data of each of the decoding modules corresponding to a de-mura data type in the memory by the decoding modules based on the identifiers and the mapping relation.

2. The display device driving method as claimed in claim 1, wherein the step of parallel decoding the compressed de-mura data of each of the decoding modules corresponding to a de-mura data type in the memory by the decoding modules based on the identifiers and the mapping relation, comprises:

determining a position and a type of the compressed de-mura datum of each of the display units in the compression de-mura data based on the identifiers; and utilizing the decoding modules to parallel decode the compressed de-mura data of a corresponding type according to the position and the type of the compressed de-mura datum of each of the display units in the compression de-mura data.

3. The display device driving method as claimed in claim 2, wherein the step of utilizing the decoding modules to parallel decode the compressed de-mura data of a corresponding type according to the position and the type of the compressed de-mura datum of each of the display units in the compression de-mura data, comprises:

data-extracting of the compression de-mura data and acquiring the compressed de-mura data according to the positions of the compressed de-mura datum of each of the display units in the compression de-mura data;

dispensing the compressed de-mura data to corresponding ones of the decoding modules according to the types of the compressed de-mura datum of each of the display units of the compression de-mura data; and utilizing the decoding modules to decode the dispensed compressed de-mura data.

4. The display device driving method as claimed in claim 2, wherein the step of utilizing the decoding modules to parallel decode the compressed de-mura data of a corresponding type according to the position and the type of the compressed de-mura datum of each of the display units in the compression de-mura data, comprises:

dispensing the positions of the compressed de-mura datum of each of the display units in the compression de-mura data to corresponding ones of the decoding modules; and utilizing the decoding modules to data-extract the compression de-mura data according to the position of the compressed de-mura datum of each of the display units in the compression de-mura data to acquire and decode the compressed de-mura data.

5. The display device driving method as claimed in claim 2, wherein the step of determining a position and a type of the compressed de-mura datum of each of the display units in the compression de-mura data based on the identifiers, comprises:

parsing storage fields of the identifiers of the compression de-mura data to acquire one of the identifiers corresponding to each of the compressed de-mura data; and determining the position and the type of the compressed de-mura datum of each of the display units in the compression de-mura data according to contents of the identifier that is uncompressed.

6. The display device driving method as claimed in claim 2, wherein the step of determining a position and a type of the compressed de-mura datum of each of the display units in the compression de-mura data based on the identifiers, comprises:

parsing a current one of the identifiers to acquire contents of the current one of the identifiers;

determining a position of a next one of the identifiers and a type of the compressed de-mura data corresponding to the next one of the identifiers according to the contents of the current one of the identifiers; and determining a position of the compressed de-mura data corresponding to the next one of the identifiers according to the position of the next one of the identifiers and a content length of the next one of the identifiers.

7. The display device driving method as claimed in claim 2, wherein the step of determining a position and a type of the compressed de-mura datum of each of the display units in the compression de-mura data based on the identifiers, comprises:

parsing a current one of the identifiers to acquire contents of the current one of the identifiers;

determining a position of a next one of the identifiers according to the contents of the current one of the identifiers;

determining a position of the compressed de-mura data corresponding to the next one of the identifiers according to the position of the next one of the identifiers and a content length of the next one of the identifiers; and determining a type of the compressed de-mura datum of the corresponding to the next one of the identifiers according to contents of the next one of the identifiers and a storage sequence of the compressed de-mura data of different types of the display units in the compression de-mura data.

8. A display device, comprising:

a display panel comprising display units arranged in an array, the display units comprising at least one pixel unit;

a storage device configured to store compression de-mura data in a compressed state, wherein the compression de-mura data comprises a compressed de-mura datum of each of the display units and an identifier configured to identify a position of each of the compressed de-mura data;

a memory comprising a plurality of decoding modules configured to read the compression de-mura data stored in the compressed state in the storage device and load the compression de-mura data into a memory, and configured to call at least two of the decoding modules, based on the identifiers, and configured to parallel decode the compression de-mura data corresponding to a current display position in the memory by the at least two decoding modules based on the identifiers, and acquiring an actual de-mura datum of each of the display units after decoding in the current display position; and a driver chip configured to utilize the actual de-mura datum of the each of the display units to drive the display panel to operate;

wherein the memory is further configured to: establish a mapping relation between the decoding modules and the de-mura data; read the compression de-mura data corresponding to the current display position in the memory; and parallel decode the compressed de-mura data of each of the decoding modules corresponding to a de-mura data type in the memory by the decoding modules based on the identifiers and the mapping relation.

9. The display device as claimed in claim 8, wherein the display panel comprises at least one of a liquid crystal display panel and an organic light emitting diode (OLED) display panel.

10. The display device as claimed in claim 8, wherein the memory is further configured to: determine a position and a type of the compressed de-mura datum of each of the display units in the compression de-mura data based on the identifiers; and utilize the decoding modules to parallel decode the compressed de-mura data of a corresponding type according to the position and the type of the compressed de-mura datum of each of the display units in the compression de-mura data.

11. The display device as claimed in claim 10, wherein the memory is further configured to: data-extract of the compression de-mura data and acquire the compressed de-mura data according to the positions of the compressed de-mura datum of each of the display units in the compression de-mura data; dispense the compressed de-mura data to corresponding ones of the decoding modules according to the types of the compressed de-mura datum of each of the display units of the compression de-mura data; and utilize the decoding modules to decode the dispensed compressed de-mura data.

12. The display device as claimed in claim 10, wherein the memory is further configured to: dispense the positions of the compressed de-mura datum of each of the display units in the compression de-mura data to corresponding ones of the decoding modules; and utilize the decoding modules to data-extract the compression de-mura data according to the position of the compressed de-mura datum of each of the display units in the compression de-mura data to acquire and decode the compressed de-mura data.

13. The display device as claimed in claim 10, wherein the memory is further configured to: parse storage fields of the identifiers of the compression de-mura data to acquire one of the identifiers corresponding to each of the compressed de-mura data; and determine the position and the type of the compressed de-mura datum of each of the display units in the compression de-mura data according to contents of the identifiers that are decoded.

14. The display device as claimed in claim 10, wherein the memory is further configured to: parse a current one of the identifiers to acquire contents of the current one of the identifiers; determine a position of a next one of the identifiers according to the contents of the current one of the identifiers; and determine a position of the compressed de-mura data corresponding to the next one of the identifiers according to the position of the next one of the identifiers and a content length of the next one of the identifiers.

15. The display device as claimed in claim 10, wherein the memory is further configured to: parse a current one of the identifiers to acquire contents of the current one of the identifiers; determine a position of a next one of the identifiers according to the contents of the current one of the identifiers; determine a position of the compressed de-mura data corresponding to the next one of the identifiers according to the position of the next one of the identifiers and a content length of the next one of the identifiers; and determine a type of the compressed de-mura datum of the corresponding to the next one of the identifiers according to contents of the next one of the identifiers and a storage sequence of the compressed de-mura data of different types of the display units in the compression de-mura data.

16. The display device as claimed in claim 8, wherein the display panel comprises a first substrate and a second substrate that are disposed opposite to each other in a cell, and a liquid crystal layer filled between the first substrate and the second substrate, the first substrate comprises an underlay, a driver circuit layer, a pixel electrode layer and a diffusing layer, the driver circuit layer is formed on a side of the underlay; the pixel electrode layer is formed on a side of the driver circuit layer away from the underlay and comprises a plurality of pixel electrodes arranged in an array and independent from one another, each of the pixel electrodes comprise an electrode surface located away from the underlay; the diffusing layer is formed on a side of the pixel electrode layer away from the driver circuit layer and comprises a plurality of diffusing members arranged in an array and connected to one another, the diffusing members correspond to the pixel electrodes, each of the diffusing members comprises a light emitting surface away from the pixel electrodes, and an area of the light emitting surface is greater than an area of the electrode surface.

17. The display device as claimed in claim 16, wherein the light emitting surface is a convex surface.

18. The display device as claimed in claim 16, wherein the light emitting surface is a concave surface.

* * * * *